US005390520A

United States Patent [19]

Hermes et al.

[11] Patent Number: 5,390,520

[45] Date of Patent: Feb. 21, 1995

[54] CLOSED-FRAME TYPE PIPE-BENDING PRESS

[75] Inventors: Rolf Hermes; Manfred Kolbe, both of Mönchengladbach, Germany

[73] Assignee: Mannesmann Aktiengesellshaft, Dusseldorf, Germany

[21] Appl. No.: 61,666

[22] Filed: May 14, 1993

[30] Foreign Application Priority Data

May 15, 1992 [DE] Germany ..... 4215807

[51] Int. Cl.[6] ..... B21D 5/02

[52] U.S. Cl. ..... 72/21; 72/389; 72/453.08; 72/481

[58] Field of Search ..... 72/21, 389, 453.08

[56] References Cited

U.S. PATENT DOCUMENTS 5,012,661 5/1991 Catti et al. ..... 72/389
5,067,340 11/1991 MacGregor ..... 72/453.08
5,193,452 3/1993 Dieperink ..... 72/389

FOREIGN PATENT DOCUMENTS 2-147120 6/1990 Japan ..... 72/389
4-105714 4/1992 Japan ..... 72/481
5-15929 1/1993 Japan ..... 72/21

*Primary Examiner*—David Jones
*Attorney, Agent, or Firm*—Cohen, Pontani, Lieberman, Pavane

[57] ABSTRACT

A pipe-bending press with a large bending length in a closed frame construction, has a frame with side columns and upper and lower cross-pieces. The table supporting the lower bending tools is supported at the lower cross-piece and the upper bending tool which is guided vertically at the side columns in a parallel manner is supported via a plurality of identical piston/cylinder units arranged side by side so that the upper bending tool can be raised and lowered relative to the upper cross-piece. The cylinder spaces of the piston/cylinder units are connected to a common pressure medium unit via a common control line, and the lower piston/cylinder units are arranged between the table supporting the lower bending tools and the lower cross-piece.

7 Claims, 1 Drawing Sheet

CLOSED-FRAME TYPE PIPE-BENDING PRESS

BACKGROUND OF THE INVENTION

1. Field of the Invention

The invention is directed to a pipe-bending press with a large bending length in closed frame construction. The press has a frame with side columns and upper and lower cross-pieces, wherein the bed or table carrying the lower bending tools is supported at the lower cross-piece while the upper bending tool, which is guided vertically at the side columns in a parallel manner, is supported via a plurality of identical piston/cylinder units arranged side by side so that it can be raised and lowered relative to the upper cross-piece. Additionally, the cylinder spaces of the piston/cylinder units are connected to a common pressure medium unit via a common control line.

2. Description of the Related Art

Such presses are known, for example, from DE-AS 10 72 948 or DE-AS 24 55 521. In such presses with closed frame-like columns, large bending moments result which require the table and bending tool to have very large moments of inertia the table and bending tool in order to keep the deflection or bending of these parts within permissible limits. Even when the upper and lower cross-pieces of the pipe-bending press have correspondingly large dimensions, a bending up of the frame cannot be ruled out, even in the lower region of the press, that is, in the region of the table receiving the lower bending tools. The steps provided in the prior art also cannot prevent the press frame from bending up, particularly not without a disproportionate increase in the overall size or height of the press.

SUMMARY OF THE INVENTION

Proceeding from the cited prior art and the bending press described therein, it is an object of the present invention to prevent the bending of the bending tools by the use of relatively simple means so as to enable the production of an accurately dimensioned and qualitatively flawless pipe.

Pursuant to this object, and others which will become apparent hereafter, one aspect of the present invention resides in arranging the lower piston/cylinder units between the table supporting the lower bending tools and the lower cross-piece.

Thus, the present invention places the lower piston/-cylinder units in opposition to the upper piston/cylinder units and the bending of the table can be completely prevented by these lower piston/cylinder units even if the lower cross-piece should bend under the work load of the press.

According to a further embodiment of the invention the lower piston/cylinder units can be controlled individually and regulated with respect to pressure as a function of distance. In this way, a bending of the table can be opposed in an entirely controlled manner by varying the pressure acting upon individual piston/cylinder units In order to detect deviations from an initial state, in another embodiment of the invention a measuring beam, which is rigid against bending, extends from one side column to the other so as to be parallel to a structural component part (i.e., table, bending tool) which is subjected to bending when loaded, and cooperates with distance measuring devices by which deviations from a rest position of these structural component parts when acted upon by bending forces can be detected. The measured-value signal of these distance measuring devices being usable for acting upon the lower piston/cylinder units with the pressure medium.

In still a further embodiment of the invention the lower piston/cylinder units are connected with a common pressure medium unit via a common control line.

In a manner similar to that already realized in the upper piston/cylinder units, the cylinder spaces of the lower piston/cylinder units communicate with one another so that the same pressure is available at all the pistons. Accordingly, an opposing force acts against a bending of the table even when the lower cross-piece deforms. It is only necessary to ensure that one of the piston/cylinder units or an additional piston/cylinder unit can be controlled as a function of distance in a known manner so that the upper and lower bending tool, whose construction is movably suspended or floating in other respects, can be kept within a defined center position.

In an additional embodiment the lower piston/cylinder units are connected with the upper piston/cylinder units via common pressure medium lines. This connection results in a practically closed system in which the bending forces can be transmitted to the frame parts only via the upper and lower piston/cylinder units.

Advantageously, the upper and lower piston/cylinder units are arranged coaxially relative to one another and are identically dimensioned.

The present invention offers two solutions by which the bending of the bending tools of a press of the generic type can be realized using simple means.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
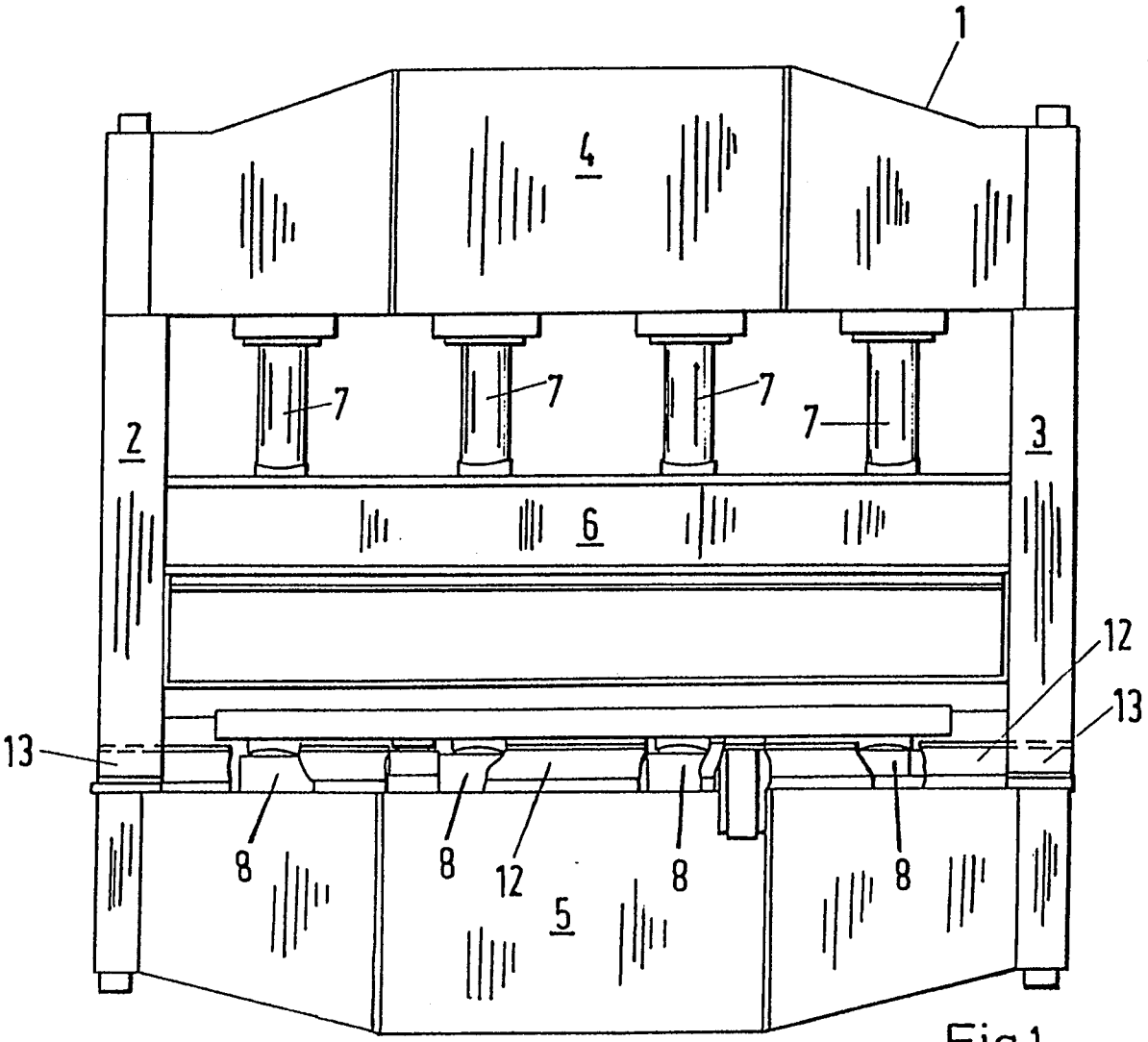
FIG. 1 is a front view of a pipe-bending press pursuant to the present invention.

As shown in FIG. 1, the frame 1 of the pipe-bending press is closed and includes side columns 2, 3, as well as an upper cross-piece 4 and a lower cross-piece 5. The upper bending tool, designated in its entirety by 6, is guided in the side columns 2, 3 so as to be vertically movable. Distance or displacement measurement transmitters, not shown, provide for synchronous running and parallel movement of the upper bending tool 6.

The upper bending tool 6 is fastened at upper piston/-cylinder units 7 so as to be movable to some extent in the manner of a cardan joint and is supported relative to the upper cross-piece 4 via the piston/cylinder units 7. All piston/cylinder units 7 are identically dimensioned, i.e. the cylinder spaces and pistons are of identical dimensions.

Figure 2:
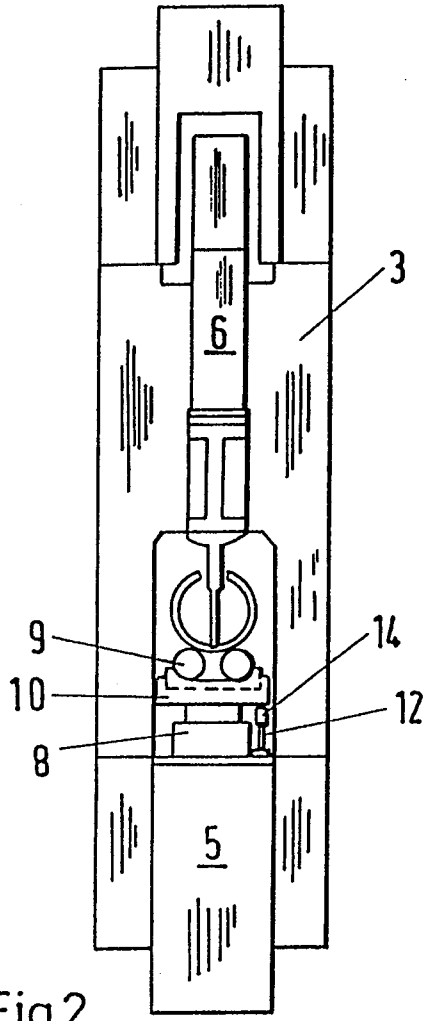
FIG. 2 is a side view of the press according to FIG. 1.

As can be seen in FIG. 2, a table 10 supporting lower bending tools 9 is likewise supported at piston/cylinder units 8 which are in turn supported at the lower cross-piece 5. These lower piston/cylinder units 8 are arranged so that they act coaxially relative to the upper piston/cylinder units 7. The table 10 is supported so that it can be raised and lowered as well as tilted in a straight-line guide.

According to the present invention, the upper piston/cylinder units 7 and the lower piston/cylinder units 8 can either communicate between or with one another via pressure medium lines, or the lower piston/cylinder units 8 can be controlled individually according to a further teaching of the invention. To this end, a beam 12, which is rigid against bending and constructed as an I-beam, is arranged between the table 10 and the lower cross-piece 5 of the frame 1 and is supported at both sides 13 in the side columns 2, 3. This I-beam 12 cooperates with distance measuring devices 14 which detect the distance between the I-beam 12 and the table 10 of the lower bending tool 9. The change in distance provides a measurement of the bending of the table 10, which can be compensated for by controlling individual, or more than one, piston/cylinder units 8. In this way, an exactly straight alignment of the table 10 is ensured.

While the invention has been illustrated and described as embodied in a closed-frame type pipe-being press, it is not intended to be limited to the details shown, since various modifications and structural changes may be made without departing in any way from the spirit of the present invention.

Without further analysis,the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A pipe-bending press having a large bending length, comprising:

a closed frame including vertical side columns, an upper cross-piece and a lower cross-piece;

a table on which lower bending tools are carried, said table being supported at said lower cross-piece;

an upper bending tool arranged so as to be vertically guided at such side columns in a parallel manner; a plurality of identical upper piston/cylinder units arranged side-by-side so as to support said upper bending tools so that said upper bending tool can be raised and lowered relative to said upper cross-piece; a pressure medium unit connected to cylinder spaces of said piston/cylinder units by a common control line;

a plurality of lower piston/cylinder units arranged between said table and said lower cross-piece, said lower piston/cylinder units being individually controllable and regulatable with respect to pressure as a function of distance; and a measuring beam that is rigid against bending and extends from one of said side columns to another of said side columns so as to be parallel to a structural component part which is subjected to bending when loaded, said measuring beam being arranged so as to cooperate with distance measuring means for detecting deviations from a rest position of the structural part when acted upon by bending forces, said measuring means producing a measured-value signal usable for acting upon said lower piston/cylinder units with a pressure medium.

2. The pipe-bending press according to claim 1, wherein said lower piston/cylinder units are connected with a further common pressure medium unit via a common control line.

3. The pipe-bending press according to claim 1, wherein said lower piston/cylinder units are connected with said upper piston/cylinder units via common pressure medium lines.

4. The pipe-bending press according to claim 2, wherein said lower piston/cylinder units are connected with said upper piston/cylinder units via common pressure medium lines.

5. The pipe-bending press according to claim 1, wherein said upper and lower piston/cylinder units are arranged coaxially relative to one another and have identical dimensions.

6. The pipe-bending press according to claim 2, wherein said upper and lower piston/cylinder units are arranged coaxially relative to one another and have identical dimensions.

7. The pipe-bending press according to claim 3, wherein said upper and lower piston/cylinder units are arranged coaxially relative to one another and have identical dimensions.

* * * * *